United States Patent [19]

Filak

[11] 4,074,811

[45] Feb. 21, 1978

[54] MULTI-LEVEL KNOCK-DOWN FRAMEWORK STRUCTURE FOR SUPPORTING A PLURALITY OF OBJECTS

[76] Inventor: Andrew M. Filak, 4108 Seahorse Lane, Portuguese Bend, Calif. 90274

[21] Appl. No.: 622,725

[22] Filed: Oct. 15, 1975

[51] Int. Cl.[2] ..... A47B 43/00

[52] U.S. Cl. ..... 211/191; 211/182; 248/245

[58] Field of Search ..... 211/189, 190, 191, 192, 211/182, 175, 208, 209, 13, 49 R, 49 D; 248/221, 223, 224, 226 R, 235, 241, 243, 244, 245, 246, 295, 514, 121, 122, 125, 371, 398, 176, 177, 178, 185, 188.1; 403/254, 305, 254, 295, 258, 264; 151/41.76; 85/1 H

[56] References Cited

U.S. PATENT DOCUMENTS

| | | | |
|---|---|---|---|
| 678,112 | 7/1901 | Callender | 248/247 |
| 1,158,895 | 11/1915 | Clark | 403/305 |
| 1,432,349 | 10/1922 | McFarland | 151/41.76 |
| 2,321,916 | 6/1943 | Ingerman | 248/248 |
| 2,345,650 | 4/1944 | Attwood | 211/182 |
| 2,918,176 | 12/1959 | Bell et al. | 211/191 |
| 3,095,672 | 7/1963 | Di Tullo et al. | 151/41.76 X |
| 3,162,407 | 12/1964 | Yax | 248/514 |
| 3,456,706 | 7/1969 | Ollis, Jr. | 151/41.76 X |
| 3,462,110 | 8/1969 | Cheslock | 248/245 X |
| 3,567,035 | 3/1971 | Dudzik | 211/49 R |
| 3,867,048 | 2/1975 | Sudzweig | 403/252 |

FOREIGN PATENT DOCUMENTS

| | | | |
|---|---|---|---|
| 1,273,980 | 9/1961 | France | 211/207 |
| 384,832 | 2/1965 | Switzerland | 151/41.76 |
| 785,666 | 10/1957 | United Kingdom | 85/1 H |

*Primary Examiner*—Roy D. Frazier
*Assistant Examiner*—Terrell P. Lewis
*Attorney, Agent, or Firm*—Poms, Smith, Lande & Glenny

[57] ABSTRACT

A portable, multi-level knock-down frame structure for supporting a plurality of objects of varying shapes, sizes and weights in individual compartments. The materials for the structure may be selected to accommodate boats and store the same adjacent a body of water in a rust-inhibiting environment. The framework is made up of a plurality of interconnected members forming a box-like framework with vertical rows of spaced compartments. These members may be adjusted to vary the overall height of each compartment and may include means in each compartment for supporting the object to be stored, such as a boat, off of the structural members forming the framework structure and may also be adjustable with respect to the framework for accommodating objects, such as boats, of varying shapes and sizes.

13 Claims, 15 Drawing Figures

MULTI-LEVEL KNOCK-DOWN FRAMEWORK STRUCTURE FOR SUPPORTING A PLURALITY OF OBJECTS

BACKGROUND OF THE INVENTION

1. Field of the Invention

The invention relates to storage facilities, and, more particularly, to a multi-level knock-down framework structure for supporting a plurality of objects, such as boats, cars, etc., of varying sizes, shapes and weights.

2. Description of the Prior Art

In my U.S. Pat. No. 3,189,198, to A. M. Filak, I disclosed a small boat dry storage facility for storing boats in a rust-enducing manner adjacent a body of water. In this patent, a building is provided which includes a compartmented framework in which small boats may be stored each in its own compartment when not in use, and thus be protected from the elements whereby a need for a trailer is eliminated, the possibility of pilferage is minimized, the boat is readily available for use where required, and the boat owner has immediate access to a body of water.

It is further noted that, in my patent, the compartmented framework forms an integral part of the ceiling and walls of the building. In certain earthquake-prone areas, such as California, considerable damage could take place on the boats stored in such compartmented framework should an earthquake hit the building. There is thus a need for a compartmented framework structure which is independent of the walls and ceilings of the building in which it is erected. Such a structure should be relatively portable, that is, comprised of knockdown components which can be quickly and easily erected wherever required yet provide the necessary strength and means for accommodating objects, such as boats, of varying sizes, shapes and weights.

In my copending application Serial No. (34–131), entitled "Dry Dock Storage Facility for Boats", I have described a storage facility which is adapted to utilize the framework structure described and claimed in the instant application. Further, my aforementioned patent shows and describes various configurations and arrangements of a compartmented framework structure in a dry storage facility. It is to be understood that the framework structure of the instant invention may be provided in the various arrangements of frameworks C described and claimed in U.S. Pat. No. 3,189,198.

SUMMARY OF THE INVENTION

It is an object of this invention to provide a portable, knock-down framework structure for supporting a plurality of objects of varying sizes, shapes and weights which can be quickly and easily erected at any desired location.

It is a further object of this invention to provide a portable, knock-down framework structure which is particularly suited for storing boats adjacent a body of water in a rust-inhibiting manner.

It is still another object of this invention to provide such a framework structure having a plurality of adjustable compartments with adjustable boat supports therein for accommodating the bows and hulls of different sized and shaped boats.

These and other objects are preferably accomplished by providing a portable, multi-level knock-down frame structure for supporting a plurality of objects of varying shapes, sizes and weights in individual compartments made of materials which may be selected to accommodate boats and store the same adjacent a body of water in rust-inhibiting environment. The framework is made up of a plurality of interconnected members forming a box-like framework with vertical rows of spaced compartments. These members may be adjusted to vary the overall height of each compartment and may include means in each compartment for supporting the object to be stored, such as a boat, off of the structural members forming the framework structure and may also be adjustable with respect to the framework for accommodating objects, such as boats of varying shapes and sizes.

DESCRIPTION OF THE PREFERRED EMBODIMENT

Figure 2:
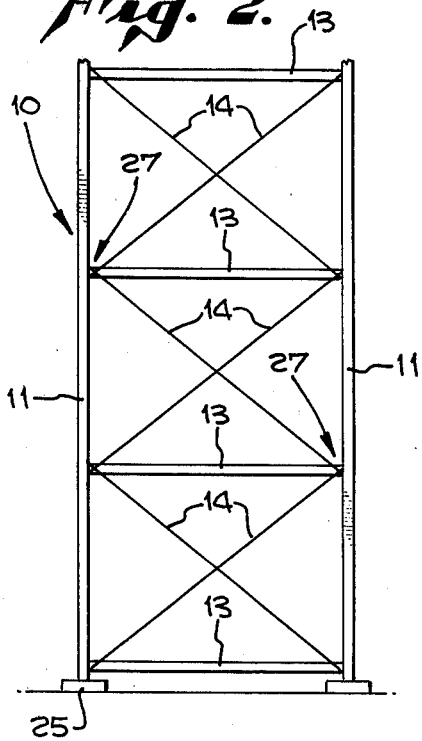
FIG. 2 is a side view of the structure of FIG. 1.
Figure 1:
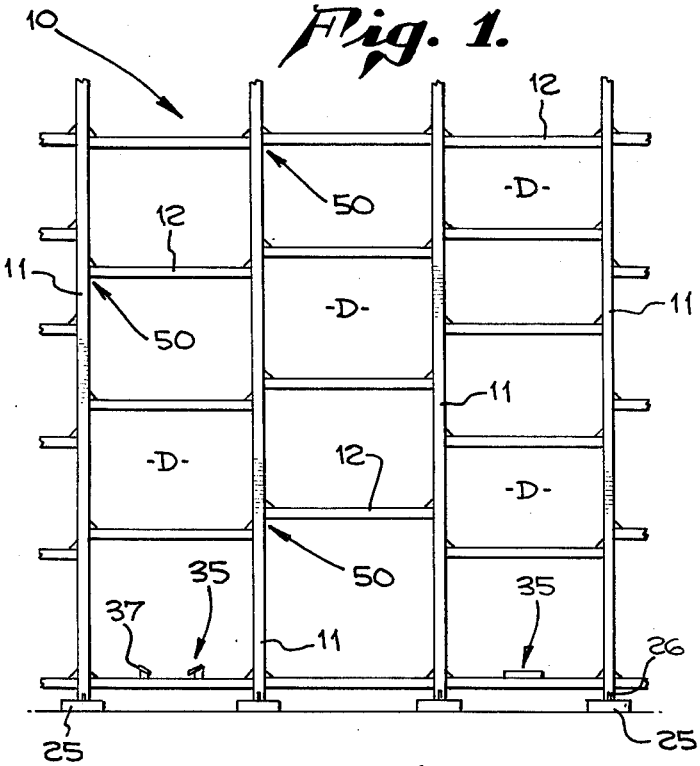
FIG. 1 is a vertical view of a vertical section of a knock-down framework structure in accordance with the teachings of my invention.
Figure 3:
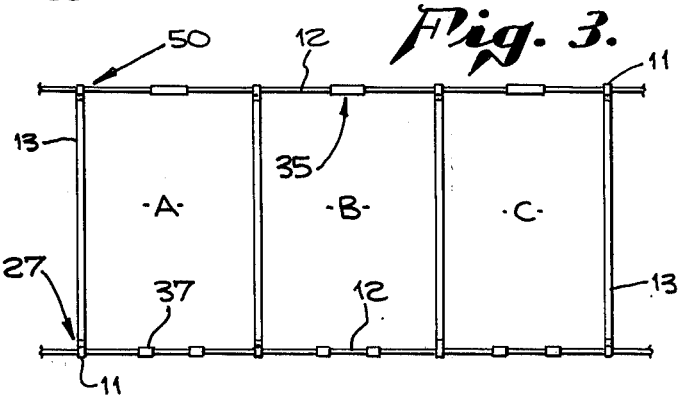
FIG. 3 is a top plan view of the structure of FIG. 1.

Referring to FIGS. 1 through 3 of the drawing, a knock-down framework structure 10 is shown which includes adjusting means 50 associated with the members making up the framework structure for varying the overall heights of the individual compartments, object support means 35 for supporting objects, such as boats, in each compartment, object support adjusting means 75 for adjusting the position of the object support means in each compartment for accommodating objects, such as boats of varying shapes and sizes, bracing means 14 for the framework structure and coupling means 17 for interconnecting members for making up elongated members for the framework structure.

Thus, referring to FIG. 1, a plurality of spaced upright support members 11 are shown which members 11 may be interconnected by generally horizontally extending support members 12 in a manner to be heretofore described. As shown in FIG. 2, members 11 & 12 may be further interconnected by horizontally extending support or spreader beam members 13 extending normal to members 12 interconnecting members 12 to members 11 forming a generally rectangular framework structure 10 as shown in plan view in FIG. 3. Also, as shown in FIG. 1, cross-brace members such as 14, may extend between members 11 through 13 as shown to provide bracing for structure 10.

Members 11 through 13, as shown in FIGS. 1 through 3, thus divide structure 10 into a plurality of spaced vertical rows, such as rows A, B & C in FIG. 3. Each row is generally rectangular in cross-section and includes an upright member 11 at each corner thereof. Further, members 12 divide each row A through C into a plurality of spaced compartments, D as shown in FIG. 1. As can be seen in FIG. 1 and as will be further described, members 12 are adjustable with respect to members 11 so that the overall height of each compartment 15 may be varied.

Although only three rows A through C are shown in FIGS. 1 and 3, with each row divided into four or five compartments D, it is to be understood that structure 10 may be as extensive as necessary to accomplish the purpose for which it is used. For example, one or more structures, such as structure 10, may be erected in a building and arranged as described and shown in my U.S. Pat. No. 3,189,198.

Figure 4:
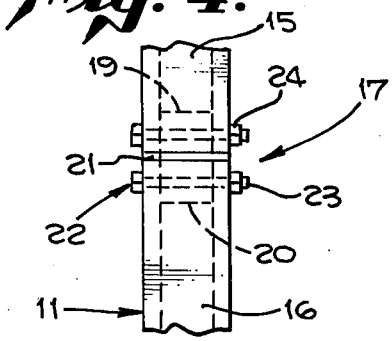
FIG. 4 is a detailed vertical view of a portion of the view of FIG. 1.
Figure 5:
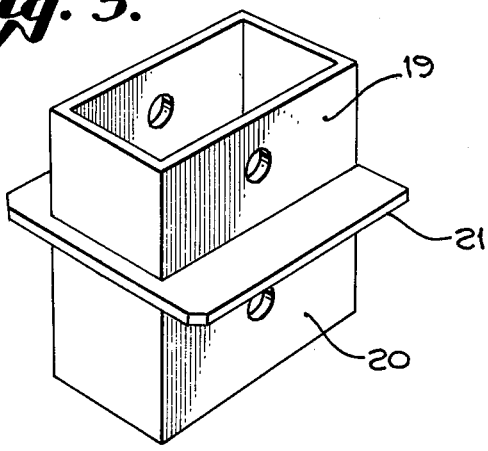
FIG. 5 is an isometric view of a component of the view of FIG. 4.

In the exemplary embodiment of the invention, each upright member 11 may be comprised of two or more interconnected sections, such as sections 15, 16 (FIG. 4). Thus, as shown in FIGS. 1, 4 and 5, in the exemplary embodiment coupling means 17, such as a coupler pin 18 (FIG. 5) may be provided having a first and second ends 19 and 20 configured as the internal cross-section of sections 15, 16 and separated by a flange or abutting plate 21. The ends of sections 15, 16 to be connected may be square cut with each end 19, 20 of pin 18 inserted into the to-be-connected ends of sections 15 and 16 as shown in FIG. 4 with these to-be-connected ends abutting against plate 21. Fastening means 22, such as bolts 23, may be inserted into aligned apertures in both sections 15, 16 and pin 18, secured by nuts 24, to thereby interconnect sections 15, 16 in a rigid manner. In this way, sections 15, 16 may be used to quickly and easily form longer upright members 11.

Figure 6:
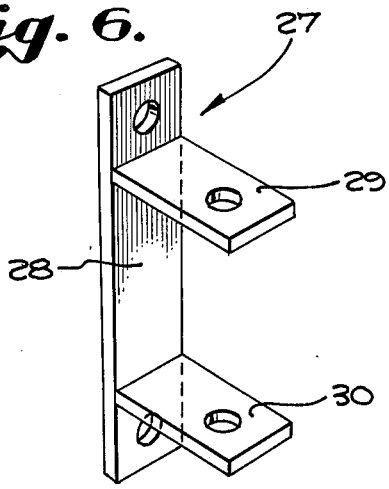
FIG. 6 is an isometric view of a component of the structure of FIG. 1.
Figure 7:
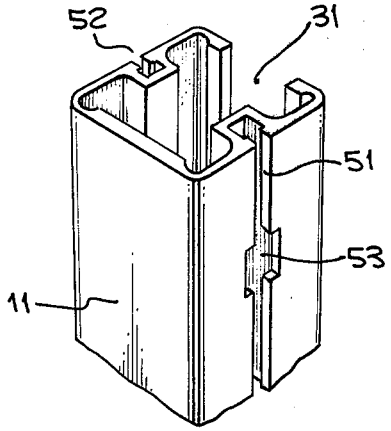
FIG. 7 is an isometric view of a portion of one of the upright members of FIG. 1.
Figure 8:
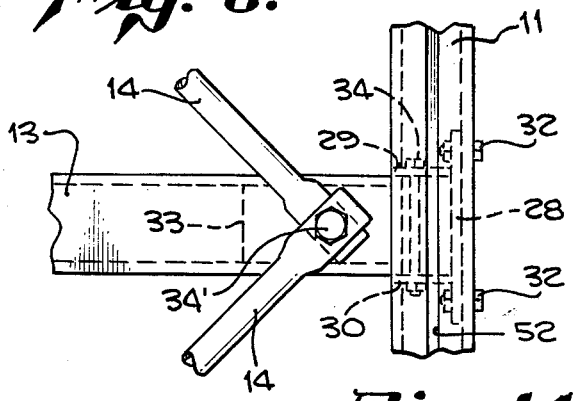
FIG. 8 is a detailed view of a portion of the structure as shown in FIG. 2 utilizing the components of FIGS. 6 & 7.

Any suitable means may be used to support structure 10 at its desired location. For example, flange plates 25 (FIG. 1) may include ends 26 insertable into the lower ends of each member 11 and bolted thereto in the manner discussed with respect to means 17. Such plates 25 may include suitable apertures (not shown) for securing plates 25 (and thus structure 10) to any desired surface. Spreader beam members 13 may also be connected to members 11 in any suitable manner, such as by connectors 27 as shown in FIG. 6 which connectors includes a flange plate 28 having a pair of outwardly extending arms 29, 30. As shown in FIG. 7, each member 11 is hollow and open on one side, as it opening 31, so that plate 28 may be inserted therein and bolted to member 11 in the manner shown in FIG. 8 via suitable nuts-and-bolts 32. A block, such as a wood block 33, may be inserted as by press-fitting into each end of spreader beam member 13 and a suitable nut-and-bolt 34 used to secure member 13 between the arms 29, 30 of connector 27. Cross-brace member 14 may be secured to members 13 and block 33 by suitable nuts-and-bolts 34'.

As will be discussed, the support members 12 are used to support objects thereon, such as boats, which vary in size. Further, although the materials for members 11 through 14 may be selected from materials, such as aluminum as for example 6061-T6 alloy extruded aluminum, and as further discussed in my patent, to provide a rust-enducing or inhibiting environment, it is desirable to keep the objects being supported on members 12 off of the members 12. Members 12 thus act as load beams for the objects being stored. Such means which maintains the objects out of direct contact with members 12 to prevent corrosion of members 12 should also be adjustable to compensate for objects, such as boats, of varying widths.

Accordingly, as particularly contemplated in the present invention, object support means 35 are provided on members 12 for supporting boats or the like thereon. As shown in FIG. 1, in the exemplary embodiment, the bow of the boat may be supported on a cushioning member, such as an elongated block 36, of wood or the the like. As will be discussed, block 36 may be adjustably secured to its respective member 12 for longitudinal movement therealong to compensate for the size of the boat being supported.

Figure 9:
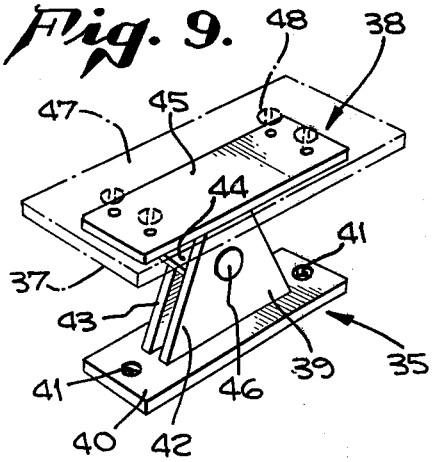
FIG. 9 is an isometric view of one of the components shown in FIG. 1.

Object support means 35 may also include, in the exemplary embodiment, means for supporting the hull of the boat. Thus, as shown in FIGS. 1 and 9, a pair of hull supports 37 may be each comprised of a first upper section 38 pivotally secured to a lower base section 39. Base section 39 includes a mounting flange 40 having apertures 41 for adjustably securing flange 40 to its respective member 12 as will be discussed. Flange 40 includes integral spaced upwardly extending generally triangular-shaped members 42, 43 for receiving therein one of a pair of like spaced generally triangular-shaped members 44 (only one shown in FIG. 9) extending downwardly from and integral with a top flange plate 45. A pivot pin 46 extends through suitable apertures in members 42, 43 and 44 so that upper section 38 is pivotal with respect to lower section 39. A cushioning member 47, which may be a fabric covered piece of wood or the like, is secured to top flange plate 45 by suitable screws 48.

A spaced pair of hull supports 37 are shown in FIG. 1 as mounted on member 12 in the lower left compartment. As can be seen, the upper sections are pivoted to a position for supporting the usual U or Vee shape of the hull of a boat and thus are adaptable to any boat configuration.

As previously discussed, the overall height of each compartment D may be adjusted to compensate for boats of varying heights. Thus, as particularly contemplated in the present invention, adjusting means 50 are provided for adjusting the height of each compartment D. In the exemplary embodiment, adjusting means 50 includes a pair of oppositely disposed longitudinal generally Tee-shaped slots 51, 52 (FIG. 7) formed in the walls of members 11 and extending substantially the entire length of each upright member 11. These slots 51, 52 serve as tracks for receiving the heads of suitable bolts or the like therein. Such bolts may be of any suitable type and are not shown in detail since conventional bolts may be used. However, in the adjusting means to be described, high tension bolts are preferred, such as those conforming to A.S.T.M.A.-325. These bolts may have a square head and thus a square-shaped opening 53 may be formed or cut-out along each slot 51, 52 at predetermined spaced locations. Opening 53 is thus configured the same as the head of the bolts and the bolt head is insertable therein, slidable in slots 51 and 52 with the shank thereof extending outwardly.

Figure 10:
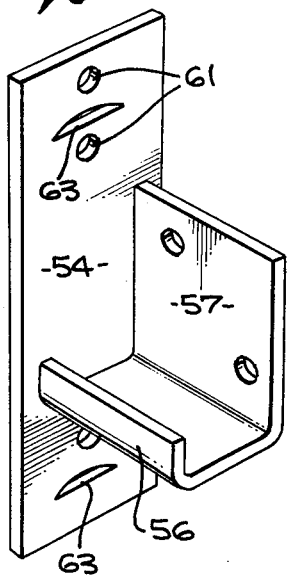
FIG. 10 is an isometric view of one of the components shown in FIG. 1.
Figure 11:
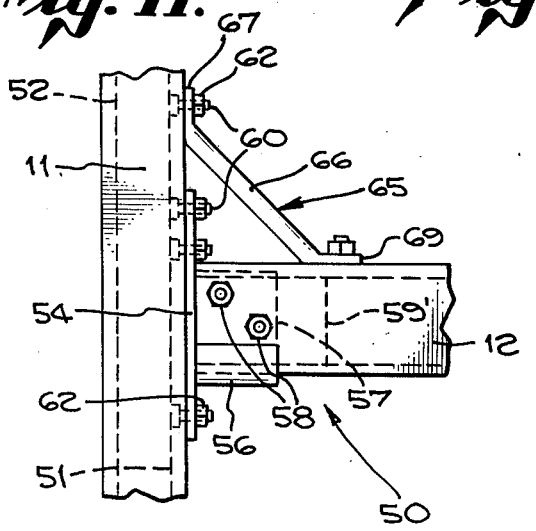
FIG. 11 is a detailed view of a portion of the structure of FIG. 1 utilizing the component shown in FIG. 10.

The adjusting means 50 further includes interconnecting means for interconnecting members 12 to members 11 in an adjustable meanner. In the exemplary embodiment, such interconnecting means for interconnecting members 12 to members 11 in an adjustable manner. In the exemplary embodiment, such interconnecting means includes a generally flat flange 54 (FIG. 10) having a generally U-shaped bracket 55 extending from one face thereof. A first leg 56 of the bracket 55 is substantially shorter than the second leg 57 so that one end of support member 12 may be quickly and easily inserted therein and secured thereto by suitable nuts and bolts 58 passing through apertures 59 in bracket 55 and through aligned apertures in members 12. A block, such as a wood block 59', may be press-fit into the ends of members 12 with the bolts of nuts and bolts 58 passing therethrough, as shown in FIG. 11. Flange 54 is secured to member 11 by the aforementioned high tension bolts (indicated at reference numeral 60 in FIG. 11), the heads thereof having been inserted in slots 51 or 52. The threaded ends of bolts 60 extend through apertures 61 in flange 54 with suitable nuts 62 securing the flange 54 to members 11. One or more chevrons 63 may be stamped out of flange 54 extending toward member 11 to hold flange 54 with respect to member 11 when nuts 62 are tightened. The bolts 60, slots 51 or 52, and chevrons 63, serve to provide retaining means for retaining members 12 at fixed, but adjustable, locations along upright members 11.

Figure 12:
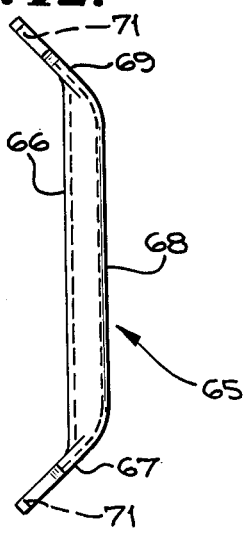
FIG. 12 is a side view of one of the components shown in FIGS. 1 & 11.

In the exemplary embodiment, bracing means 65 may be provided for bracing each member 12 with respect to its connection to upright members 11. Bracing means 65 thus includes a generally U-shaped bracket 66 (FIG. 12) having a first leg or flattened apertured portion 67, an integral elongated base portion 68 extending about 45° therefrom and a second leg or flattened apertured portion 69 integral with base portion 68 and extending outwardly away from base portion 68 at about 45° therefrom. One or more chevrons 71 may be stamped out of each end portion 67, 69 extending outwardly therefrom and toward its respective support member 11 or 12 when secured thereto.

Thus, as shown in FIG. 11, bracket 66 provides bracing means between members 11 and 12 with one end 67 secured to member 11 via bolt 60 and the other end 69 secured to member 13.

Figure 13:
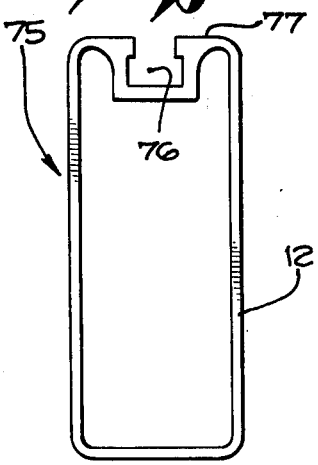
FIG. 13 is an end view of one of the structural members of FIG. 1.

Referring now to FIG. 13, as particularly contemplated in the present invention, adjusting means 75 are provided for adjusting the object support means 35, eg, block 36 and hull supports 37, at space locations along members 12. In the exemplary embodiment, such adjusting means 75 includes a Tee-shaped slot 76, similar to slots 51 and 52, formed in one wall 77 or each member 12. It is to be understood that slot 76 opens upwardly in FIG. 1 and is provided on both the front and back members 12. The aforementioned blocks 36 may be secured to members 12 by bolts, similar to bolts 60, such as machine bolts, which have heads insertable in slots 76 and movable therealong, the shanks extending through suitable apertures in blocks 36 with nuts thereon securing the blocks to the bolts and thus to members 12. In this manner, the blocks 36 are adjustable along tracks or slots 76 and may be fixed in position. Further, openings, similar to openings 51 in FIG. 7, may be provided at spaced locations for easy insertion of the heads of these bolts.

The mounting flanges 40 of the hull supports 37 may be secured to members 12 by like nuts and bolts, the heads thereof being also insertable in slots 76. In this manner, both the blocks 36 and the hull supports 37 may be moved to any suitable desired location along members 12 and tightened in positon.

It can be seen from the foregoing that I have described a racking system in which the structural members may be made of aluminum or other suitable materials and which is particularly suited for dry storage of boats of varying sizes, shapes and weights. Further, the racking system can be quickly and easily erected at any desired location without the necessity of providing support for the racking system by utilizing the walls and ceiling of a building in which it is erected. Thus, the framework structure can be totally independent of the building and therefore is particularly suited for use in earthquake-prone areas.

Although the storage of boats has been discussed, obviously the framework structure may be used to store any suitable objects. The horizontal support members 12 may be secured to the vertical members 11 without the need for special tools. The boat support means are easily movable along members 12, yet stay in place resisting side forces. These support means are adaptable to fit any boat hull configuration. Each half of each pair of hull supports 27 withstand the full weight of the boat and forces created by the misplacement of the boat and sliding thereof. These boat support members may be constructed of materials (or otherwise protected) to prevent corrosion, fungus, rotting or malfunction in salt water and/or a salt spray environment. By raising the boat off of direct contact with members 12, the material of these members 12, cannot be bared which would cause corrosion.

The framework structure may be of any suitable dimensions, as for example, 33 feet high and 27 feet wide, divided into three columns, with bays or compartments in each column of varying heights. The racking system may also be constructed of suitable materials to meet design criteria, such as for seismic and hurricane wind loads. All surfaces of the framework structure 10 may have a corrosion and/or fungus preventing coating. Any steel structural members, base plates, shims, etc. may be hot dip galvanized to meet or exceed specifications. Steel non-threaded hardware and fasteners may also be hot dip galvanized or cadmium plated to specifications.

Figure 14:
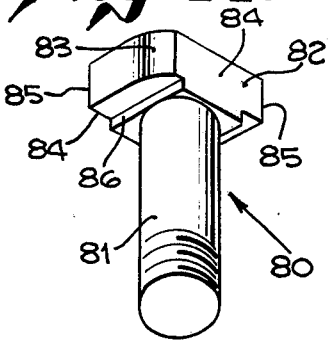
FIG. 14 is an isometric view of an alternate bolt to be used in the structure of FIG. 1.

In addition to or in place of chevrons 63, conventional star or crimp washers may be bolted at apertures 61. Although square-head bolts have been suggested to be inserted in openings 53, such bolts may have hexagonally-shaped head. Alternatively, as shown in FIG. 14, bolts 80 may be used having shanks 81 and bolt heads 82. These heads 82 have oppositely opposed curved camming surfaces 83 merging into oppositely opposed flat surfaces 84. The adjacent surfaces 83, 84 meet at sharp corners 85. Heads 82 are undercut at 86 to form stop surfaces.

Figure 15:
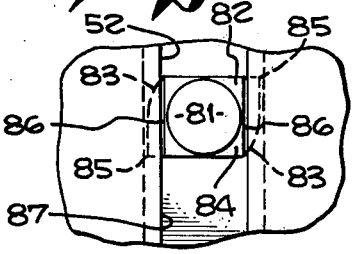
FIG. 15 is a vertical view of the bolt of FIG. 14 shown in position in the portion of the framework structure of FIG. 7.

As shown in FIG. 15, after heads 82 are inserted into openings 53 as heretofore-described, heads 82 are cammed about surfaces 83 to thereby lock in slots 51, 52 in a manner preventing lateral movement. That is, corners 85 engage the walls of slots 51, 52 locking heads 82 in position. Stop surfaces 86 abut against the sides 87 of slots 51, 52.

I claim as my invention:

1. A multi-level portable knock-down framework structure for supporting a plurality of objects of varying shapes, sizes and weights in individual compartments comprising:

a first plurality of spaced upright support members;

a second plurality of spaced support members, said first plurality of support members removably interconnecting said upright members forming a generally rectangular framework having a front, back and interconnected sides with a plurality of vertical generally rectangularly shaped rows disposed within said framework, each of said rows having an upright member at each corner thereof and divided into a plurality of vertically spaced compartments, each of said compartments having generally horizontally extending support members interconnected to said upright members separating one compartment from another, two of said last-mentioned support members associated with each compartment lying substantially in the same horizontal plane and providing a compartment having a front and a back, said two of said support members forming the front and back of each of said compartments;

adjusting means associated with both said upright members and said two of said horizontally extending members for vertically adjusting all of said two of said horizontally extending members at predetermined locations along said upright members;

object support means removably mounted on at least some of both of said two of said horizontally extending support members forming the front and back of each of said compartments, said adjusting means including said upright support members having at least one generally T-shaped slot opening outwardly thereof and extending substantially the entire length thereof along one side thereof, said horizontally extending members being secured to said upright support members by non-biased tension bolts having heads movable along said slot, said heads and said slots including retaining means thereon for retaining said horizontally extending members at various locations along said slots in said upright support members, said retaining means including said T-shaped slot having relatively flat inner walls and relatively flat side walls extending generally perpendicular to said inner walls, said walls retaining means further including said heads having a pair of oppositely opposed surfaces interconnected by a pair of oppositely opposed straight surfaces, and said head being undercut forming flattened portions extending from a point at the outer periphery of the underside of the head of each of said bolts to a point adjacent the shank of each of said bolts forming an abutting shoulder thereat so that, when said bolts are disposed in said T-shaped slots, said heads are cammed about said camming surfaces with said camming surfaces abutting against the inner walls of the cross-leg of said T-shaped slots and said flattened portions abut against the flat inner walls of the leg of said T-shaped slots with the shoulders abutting against the perpendicular portions of said slots; and interconnecting means removably interconnecting both of said two of said horizontally extending support members to said upright members, said interconnecting means including a generally flat flange having a generally U-shaped bracket extending from one face of said flange, one of the legs of said bracket being substantially shorter than the other, the ends of each of said two of said horizontally extending support members connected to said upright members having blocks press-fit in each end therein, each of said ends being insertable within said bracket and abutting against the face thereof from which said bracket extends, the opposite face of said flange being secured to an upright member, and securing means associated with said blocks, said ends of said horizontally extending support members, and said bracket for fixedly securing said last-mentioned ends in said brackets.

2. In the structure of claim 1 including a plurality of said tension bolts heads extending through a like plurality of aligned apertures in both said upright members and said flanges for securing said flanges to said upright members.

3. In the structure of claim 2 including bracing means extending between each end of each of said two of said horizontally extending support members and said upright members.

4. In the structure of claim 1 wherein said adjusting means further includes spaced enlarged openings at predetermined locations along said slots configured the same as the heads of said bolts for receiving said heads therein so that said bolts are insertable in said openings and slidable along said slots.

5. A multi-level portable knock-down framework structure for supporting a plurality of objects of varying shapes, sizes and weights in individual compartments comprising:

a first plurality of spaced upright support members;

a second plurality of spaced support members, said first plurality of support members removably interconnecting said upright members forming a generally rectangular framework having a front, back and interconnected sides with a plurality of vertical generally rectangularly shaped rows disposed within said framework, each of said rows having an upright member at each corner thereof and divided into a plurality of vertically spaced compartments, each of said compartments having generally horizontally extending support members interconnected to said upright members separating one compartment from another, two of said last-mentioned support members associated with each compartment lying substantially in the same horizontal plane and providing a compartment having a front and a back, said two of said support members forming the front and back of each of said compartments;

adjusting means associated with both said upright members and said two of said horizontally extending members for vertically adjusting all of said two of said horizontally extending members at predetermined locations along said upright members; and object support means removably mounted on at least some of both of said two of said horizontally extending support members forming the front and back of each of said compartments, said object support means including bow support means for supporting the bow of a boat mounted on one of said two of said horizontally extending support members and hull support means for supporting the hull of a boat mounted on the other of said two of said horizontally extending support members, said hull support means including a pair of spaced hull supports, each of said hull supports including a base member mounted on its respective support member and a top plate having a generally flat upper surface pivotally connected to said base member, and pivot limiting means associated with both said top plate and said base member for limiting the lateral pivot of said top plate on said base member.

6. In the structure of claim 5 wherein cross-bracing means are provided for interconnecting the front of said framework with the back thereof.

7. In the structure of claim 6 wherein each of said upright members is comprised of a pair of interconnected members, and coupling means associated with both of said last-mentioned pair of interconnected members for removably coupling together said last-mentioned interconnected members.

8. In the structure of claim 7 wherein said coupling means includes a coupler pin having one end insertable in one end of one of said last-mentioned pair of interconnected members and another end insertable into one end of the other of said last-mentioned pair of interconnected members, said coupler pin further including an abutting plate separating said one end of said coupler pin from the other end thereof, said abutting plate being substantially the same outer configuration as the outer configuration of said last-mentioned pair of interconnected members, and fastening means associated with both said coupler pin and said last-mentioned pair of interconnected members for fixedly and removably securing said last-mentioned pair of interconnected means together to form each of said upright members.

9. In the structure of claim 5 further including a plurality of bracing members interconnecting the ends of each of said two of said horizontally extending support members at their point of connection to said upright members.

10. In the structure of claim 9 wherein each of said bracing members is generally U-shaped, one leg thereof being a flattened first portion fixedly and removably secured to its respective horizontally extending member, a second enlarged integral portion forming the base thereof extending generally at an angle of about 45° therefrom, and a third flattened portion forming the other leg thereof extending generally at an angle of about 45° from said second portion in a direction away from the center of said base and removably and fixedly secured to its respective upright member, and chevrons stamped out of each of said first and third portions and extending toward and abutting against said horizontally extending members and said upright members.

11. In the structure of claim 5 further including object support means adjusting means associated with both said two of said support members and said object support means for adjusting the position of said object support means along substantially the entire length of its respective horizontally extending support means, said object support means adjusting means including both of said two of said generally horizontally extending support members having at least one generally T-shaped slot opening outwardly thereof and extending substantially the entire length thereof along one side thereof said bow support means and said base members being secured to said horizontally extending support members by tension bolts having heads movable along said slot, said heads and said slots including retaining means thereon for retaining said bow support means and said base members at various locations along said slots in said horizontally extending support members.

12. In the structure of claim 11 wherein said adjusting means further includes spaced enlarged openings at predetermined locations along said slots configured the same as the heads of said bolts for receiving said heads therein so that said bolts are insertable in said openings and slidable along said slots.

13. In the structure of claim 5 further including object support means adjusting means associated with both said two of said support members and said object support means for adjusting the position of said object support means along substantially the entire length of its respective horizontally extending support means, said object support means adjusting means including both of said two of said generally horizontally extending support members having at least one generally T-shaped slot opening outwardly thereof and extending substatially the entire length thereof along one side thereof, said object support means including connecting means connected to said object support means and movable along said last-mentioned slots, said last-mentioned connecting means and said last-mentioned slots including retaining means thereon for retaining said object support means at various locations along said slots in said horizontally extending support members.

* * * * *